US005893464A

United States Patent [19]

Kiani et al.

[11] Patent Number: 5,893,464

[45] Date of Patent: Apr. 13, 1999

[54] METHOD AND APPARATUS FOR SORTING MAILPIECES

[75] Inventors: Mohammadreza Kiani, Grand Prairie; Eddie Kin Hang Lui, Euless, both of Tex.

[73] Assignee: Siemens ElectroCom L.P., Arlington, Tex.

[21] Appl. No.: 08/496,128

[22] Filed: Jun. 27, 1995

[51] Int. Cl.[6] ..... B07C 5/00

[52] U.S. Cl. ..... 209/584; 209/900; 414/790.8

[58] Field of Search ..... 209/552, 556, 209/559, 564, 583, 584, 900; 414/265, 593, 790.8; 271/289, 290, 298, 299

[56] References Cited

U.S. PATENT DOCUMENTS

| | | | |
|---|---|---|---|
| 4,641,753 | 2/1987 | Tamada | 209/584 X |
| 5,031,223 | 7/1991 | Rosenbaum et al. | 209/900 X |
| 5,097,959 | 3/1992 | Tilles et al. | 209/900 X |
| 5,097,960 | 3/1992 | Tilles et al. | 209/584 |
| 5,215,428 | 6/1993 | Masini | 414/790.8 X |

FOREIGN PATENT DOCUMENTS

| | | | |
|---|---|---|---|
| 5116761 | 5/1993 | Japan | 414/790.8 |

*Primary Examiner*—Tuan N. Nguyen
*Attorney, Agent, or Firm*—Philip G. Meyers

[57] ABSTRACT

A mail sorting process used with a sorting machine where the next successive sort is performed during the sweeping operation of the previous sort. In a first sort, a batch of mailpieces are sorted and directed to a selected first array or group of destination pockets or bins. After the first sort is completed, the mailpieces are swept from the pockets in a sweeping operation. A second sort for sorting a second batch of mailpieces to a selected second array or group of destination pockets is begun during the sweeping operation of the first sort. As such, the sorting process sorts a batch of mailpieces to a group of destination pockets while another group of destination pockets used during a previous sort are being swept.

32 Claims, 5 Drawing Sheets

METHOD AND APPARATUS FOR SORTING MAILPIECES

TECHNICAL FIELD

The present invention relates to a sorting process for sorting mailpieces and, in particular, to a sorting process where the next successive sort is performed during the sweeping operation of the previous sort on the same sorting machine.

BACKGROUND OF THE INVENTION

With a large number, and continually growing, number of mailpieces being processed, it is becoming increasingly important to provide an efficient process to sort the mailpieces. In general, one large sorting machine is used to sort the mail for delivery to various geographic locations. Typically, the mailpieces are sorted according to a sort scheme into numerous groups (e.g. a range of ZIP codes, ZIP code (5 digits), ZIP code (9 digits), etc.).

The United States Postal Service gives more monetary discounts to a mailing that has a finer resolution of sortation (i.e. postal carrier route level). As such, with existing finite sized sorting machines, a large number of sort schemes and sorts will be required to properly sort the mailpieces to the resolution dictated and for carrier route qualified mail.

The present process of sorting mail utilizes one large sorting machine performing numerous sorts according to a sort scheme. A batch of mailpieces are fed into the sorting machine with the address or bar code of each mailpiece being read. The sorting machine directs each mailpiece into an appropriate destination "pocket" or "bin" in accordance with the sort scheme. After the entire batch is sorted with each mailpiece sorted into a particular pocket, the sweeper then "sweeps" the mailpieces. During the sweeping process, all the mailpieces in the pockets are removed from the pockets. After completion of the sweeping process, a new batch of mailpieces can be sorted.

The problem with the present sorting process is that it is necessary to stop the sorting machine after all the mailpieces for a particular sort scheme are sorted. This is required to allow the sweeper to sweep the sorted mailpieces from the pockets before the next sort scheme can be run. Mailpieces directed to the same pocket from two different sort schemes cannot be mixed as they are directed to different geographic locations. As such, the amount of time for the end-of-sort-scheme sweep is non-productive time. During this time, the sorting machine is not sorting any mailpieces to the pockets. Consequently, the sorting machine is not being used efficiently. With the increased number of sort schemes needed to sort to the postal carrier level, the amount of non-productive time is increased dramatically, and the time inefficiency of the sorting machine is exacerbated.

Accordingly, there exists a need for a sorting process that minimizes or reduces the amount of time the sorting machine is not in operation (sorting mailpieces to the pockets). Such a system will increase efficiency by minimizing the amount of time that the sorting machine is not processing mail. Furthermore, a sorting process is needed that realizes efficient use of the sorting machine down to the postal carrier level.

SUMMARY OF THE INVENTION

According to the present invention, there is provided a sorting process for sorting mailpieces in a sorting machine. The sorting process includes the step of sorting, during a first time frame and in accordance with a first scheme, a first batch of mailpieces into a first array of pockets of the sorting machine. After the first batch of mailpieces is sorted according to the first sort scheme, the sorted mailpieces are swept from the first array of pockets of the sorting machine during a second time frame. During the second time frame, a second batch of mailpieces is sorted into a second array of pockets in accordance with a second scheme.

According to an alternative embodiment of the present invention, there is provided a mail sort scheme for sorting mailpieces. Address or bar code information from a group of mailpieces is obtained and this information is stored. From this stored information, a sort scheme is generated for sorting the mailpieces to a specific level. The mailpieces are then sorted according to the generated sort scheme wherein the sorting process includes sorting in a first sub-scheme a first batch of mailpieces into a first array of pockets of a sorting machine, sweeping the sorted first batch of mailpieces from the first array of pockets of the sorting machine, and sorting in a second sub-scheme a second batch of mailpieces into a second array of pockets of the sorting machine whereby at least a portion of the second sub-scheme sorting is performed during the sweeping of the sorted first batch of mailpieces.

DESCRIPTION OF THE DRAWINGS

For a more complete understanding of the present invention and the advantages thereof, reference is made to the following detailed description taken in conjunction with the accompanying drawings wherein.

DETAILED DESCRIPTION

Figure 1:
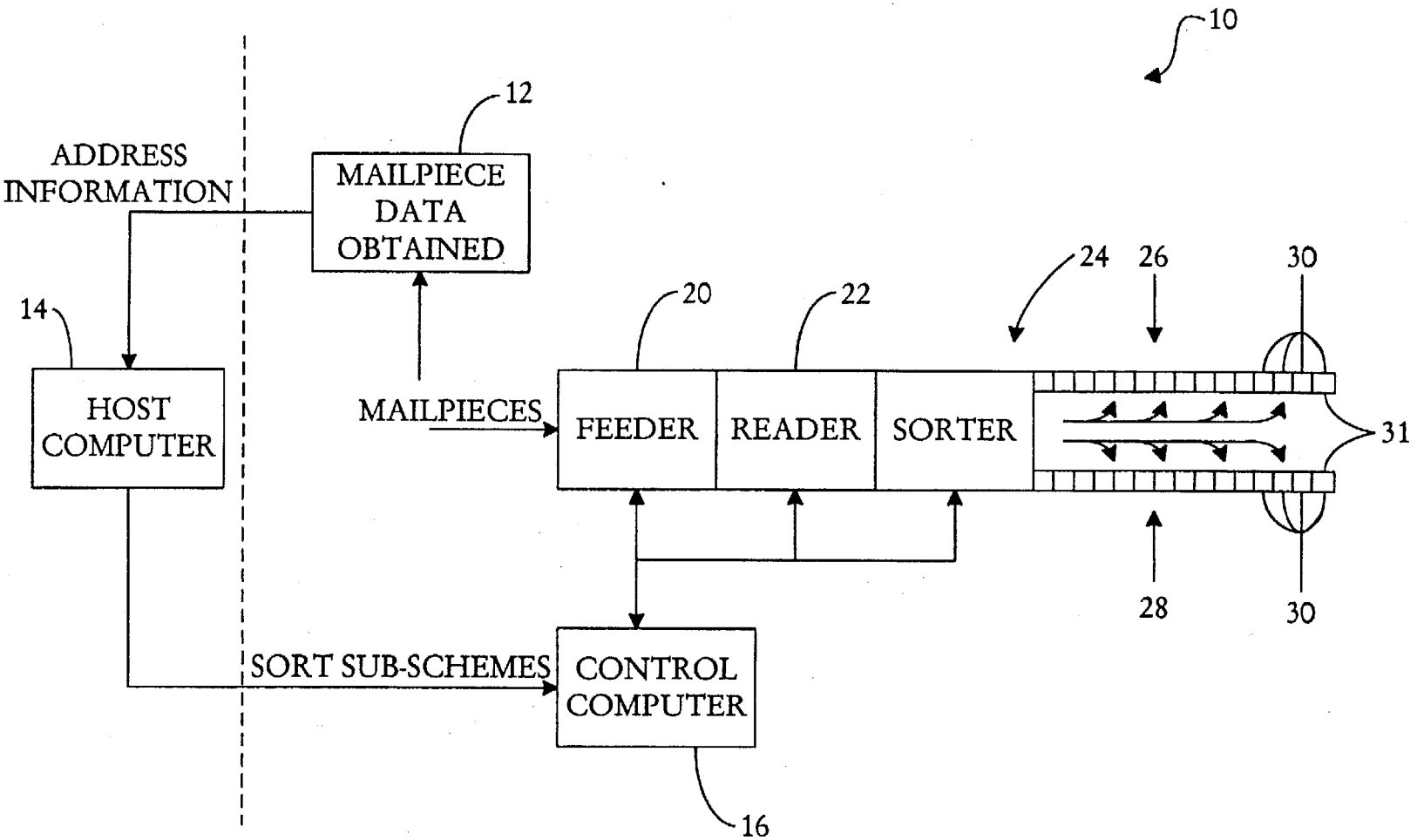
FIG. 1 illustrates a mail sorting system utilizing the process in accordance with the present invention.

With reference to the drawings, like reference characters designate like or similar parts throughout the drawings.

With reference to FIG. 1, there is shown a mail sorting system 10 utilizing the sorting process of the present invention. Address or bar code information is obtained from a group or batch of mailpieces by a block 12. This information is then transferred to a host computer 14. The host computer 14 stores the mailpiece address or bar code information in memory. The host computer 14 uses the address or bar code information from the mailpieces to generate one complete sort scheme. This one complete sort scheme will contain numerous sort sub-schemes. The sort sub-schemes are then transmitted to a control computer 16. The control computer controls the subsequent feeding, reading and sorting process of the mailpieces.

During a selected sort sub-scheme process, a batch (or group) of mailpieces associated with the selected subscheme is fed into a feeder 20. The feeder 20 singulates the mailpieces for individual feeding into a reader 22. The reader 22 reads the address or bar code information from each mailpiece as it passes through the reader to determine if that mailpiece belongs with the selected sub-scheme. A sorter 24 sorts the mailpiece according to the selected sort sub-scheme.

The sorter 24 includes a plurality of destination pockets 30 having entry openings 31. Sometimes these pockets 30 are referred to as bins. In the preferred embodiment, the plurality of pockets 30 are organized into a first array of pockets 26 and a second array of pockets 28, which may be disposed in spaced, opposing rows as shown in FIG. 1. The first and second array of pockets can also be referred to as the first half and the second half of pockets or the front side and the back side of pockets. As will be appreciated, the destination pockets 30 may be divided into any number of arrays or groups, and may contain any number of individual pockets 30.

After all the mailpieces for a selected sort sub-scheme have been sorted to the selected sub-scheme pockets, a sweep operation is performed to sweep the mailpieces out of the pockets in order to perform another sort on a different batch or group of mailpieces. As such, the process in accordance with the present invention sorts a batch of mailpieces in accordance with a first sort sub-scheme into a selected first array of pockets 26, and during the sweep operation of the first array of pockets 26, begins sorting a second batch or group of mailpieces into a selected second array of pockets 28 different from the first array of pockets 26. Accordingly, the sorter 24 sorts a batch of mailpieces to a first group of pockets and, instead of shutting down to sweep all the pockets (as is in conventional sorting processes), the sorter 24 sorts a second batch of mailpieces using a second sort sub-scheme into a different group of pockets concurrently with the sweeping of mailpieces from the first group of pockets.

Figure 2:
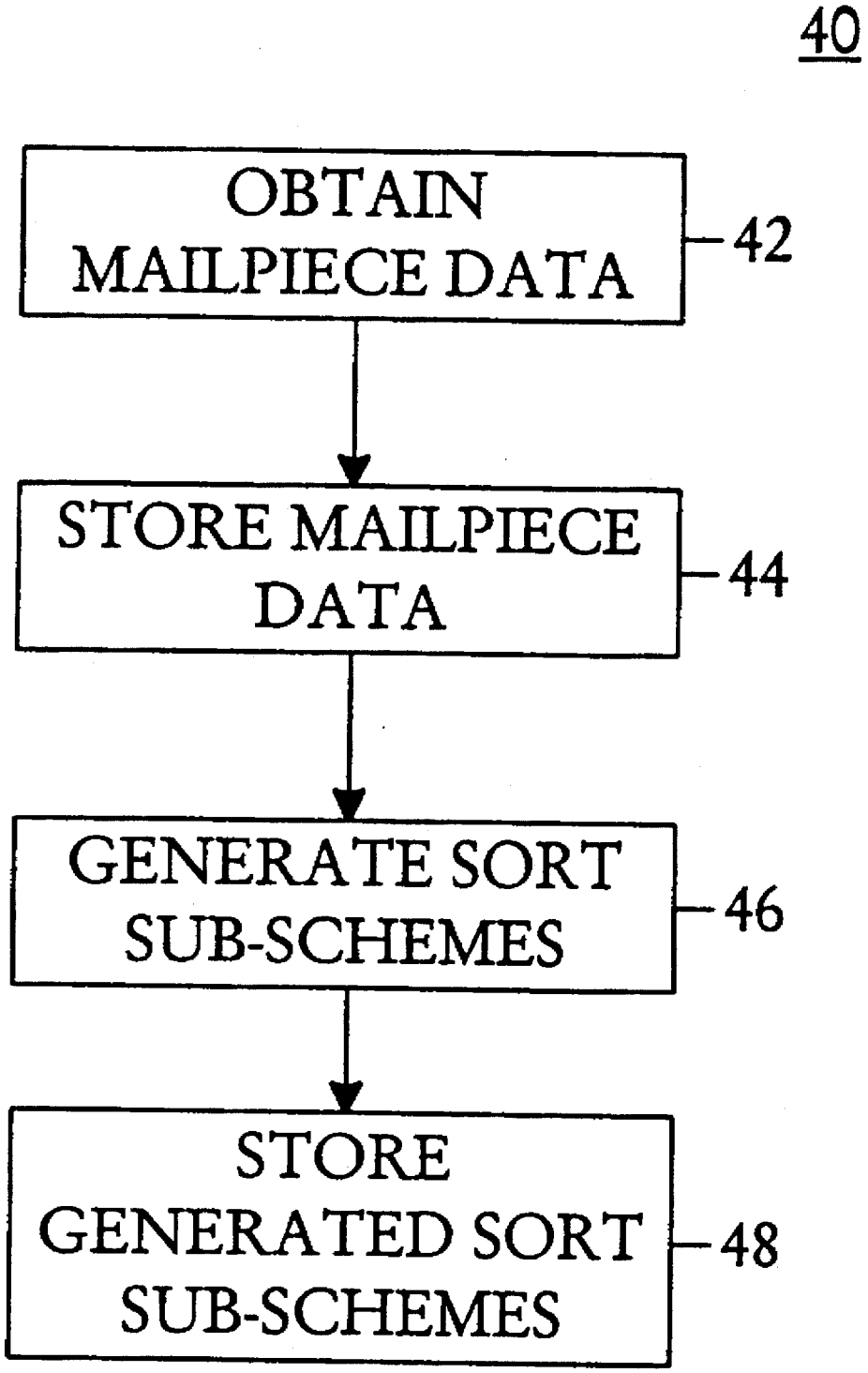
FIG. 2 illustrates a process for obtaining address information and generating sort sub-schemes to be used with the present invention.

Now referring to FIG. 2, there is shown a flow diagram 40 illustrating the process for generating sort sub-schemes to be used with the mail sorting system 10. In a step 42, address information of each mailpiece is obtained and is stored as mailpiece data in a step 44. The stored mailpiece data is used in a step 46 to generate a sort scheme that includes sort sub-schemes. The sort sub-schemes generated in the step 46 are then stored in a step 48.

The sort scheme generated in the step 46 is generated by a computer software program. Such a computer program may be software that generates a sort scheme to efficiently sort the mailpieces. The sort scheme is generated from the address or bar code information obtained from each mailpiece. One such program which generates a sort scheme is software sold under the trademark SORTGEN by Electro-Com Automation, L.P. Alternatively, any one of many available programs could generate a sort scheme to meet any set of desired user parameters.

Figure 3:
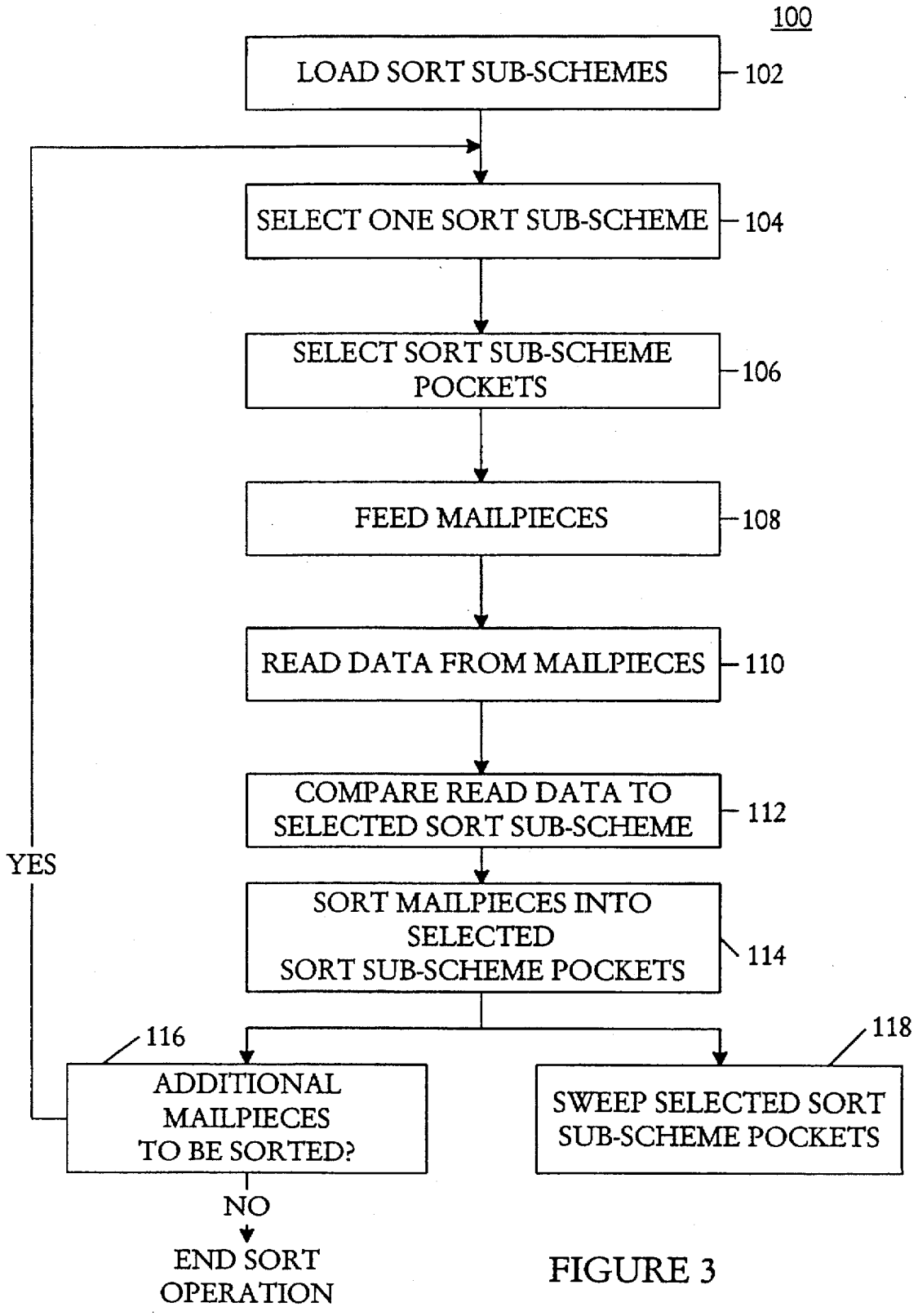
FIG. 3 is a flow diagram illustrating the basic process of sorting the mailpieces according to the sort sub-schemes.

Now referring to FIG. 3, there is shown a flow diagram 100 illustrating the process for sorting mailpieces according to a sort sub-scheme. After the sort scheme is generated, the sort sub-schemes are loaded into the control computer 16 (shown in FIG. 1) in a step 102. Next, in a step 104, one of the sort sub-schemes is selected to sort a batch or group of mailpieces associated with the selected sort sub-scheme. After the sort sub-scheme is selected, in a step 106, the sorter 24 selects (from information contained in the selected sort sub-scheme) an array of destination pockets 30 for the to be sorted mailpieces. The batch of mailpieces are fed into the feeder 20 (shown in FIG. 1) in a step 108 to be separated and sequentially fed into the reader 22 (shown in FIG. 1). In a step 110 and a step 112, the reader 22 reads the address or bar code information from each mailpiece and compares the read address or bar code information to the selected sort sub-scheme to determine if the mailpiece belongs to the sort sub-scheme. If the mailpiece matches, the sorter 24 sorts the mailpiece by directing it to the appropriate selected sort sub-scheme group of destination pockets 30. In the step 112, if a mailpiece does not match, that mailpiece is rejected. The sorter continues sorting the mailpieces until there are no more mailpieces to be sorted in the selected sort sub-scheme. When no more mailpieces exist to be sorted according to the selected sort sub-scheme, the selected sort sub-scheme is completed. If there are more batches of mailpieces to be sorted by other sort sub-schemes, as determined by a step 116, the process returns to the step 104 to select another sort sub-scheme. Additionally, after all mailpieces are directed to the destination pockets 30, a sweeping operation is performed in a step 118 to sweep all the selected sort sub-scheme destination pockets of mailpieces.

Figure 4:
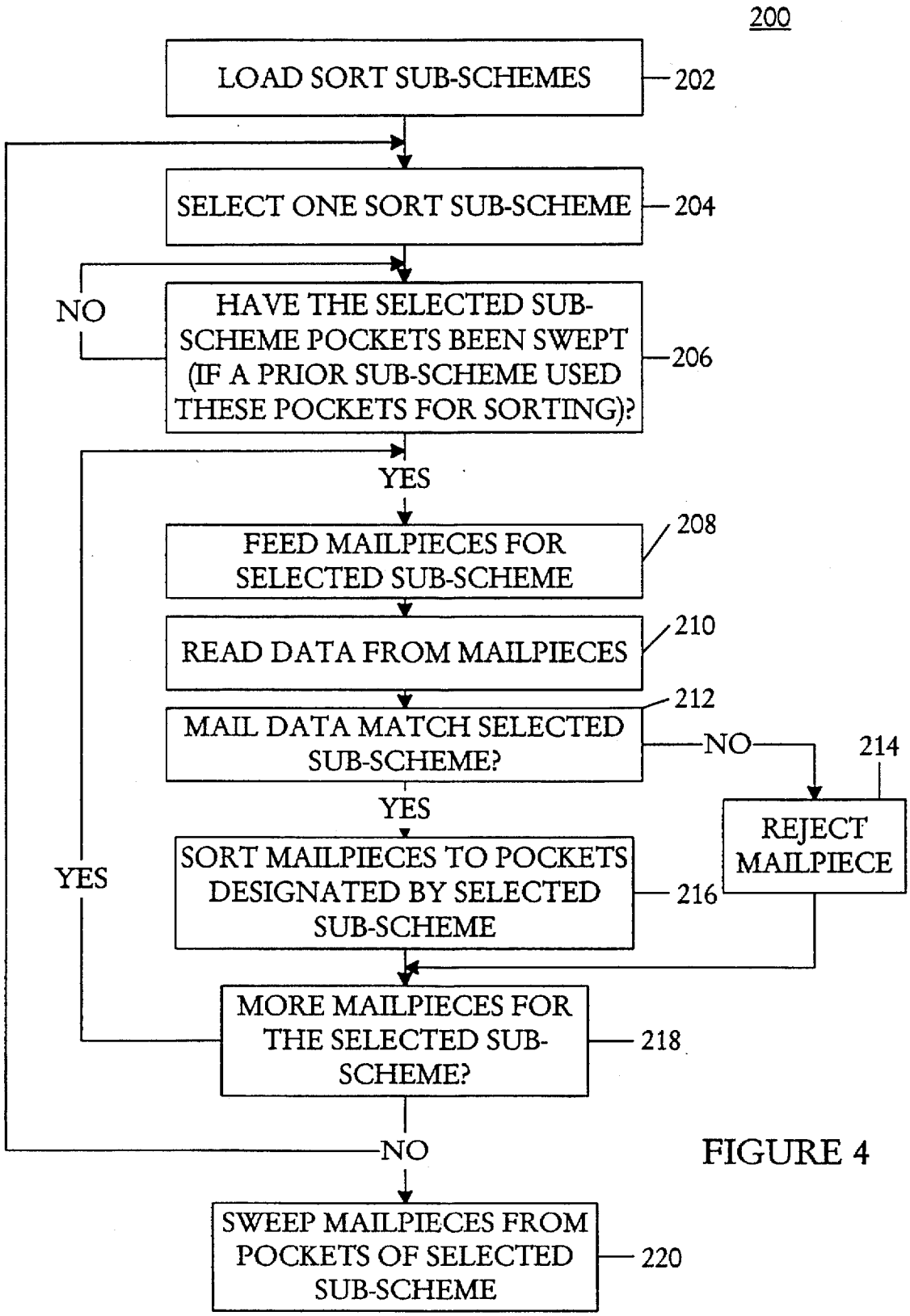
FIG. 4 is a flow diagram of the process of performing a first sort utilizing a portion of the destination pockets, thereafter a sweep of those pockets is performed after the first sort is completed and a second sort is begun at a time during the sweeping operation of the pockets of the first sort.

Now referring to FIG. 4, there is shown a flow diagram 200 illustrating the process of performing a first sort utilizing a portion of the destination pockets, and thereafter sweeping those pockets after the first sort is completed and beginning a second sort during the sweeping operation of the pockets of the first sort. After the sort scheme is generated, the sorted sub-schemes are loaded into the control computer 16 in a step 202. Next, in a step 204, one of the sort sub-schemes is selected to sort a batch or group of mailpieces associated with the selected sort sub-scheme.

In a step 206, it is determined whether the destination pockets associated with the selected sort sub-scheme have been swept (only if a prior sort sub-scheme used these pockets for sorting). If not, a sweeping process is taking place for these pockets and the sort sub-scheme selected in the step 204 cannot be performed until the sweeping operation is finished. If the pockets have been swept, a mailpiece is singulated by the feeder 20 in a step 208 and is fed into the reader 22. In a step 210, the reader 22 reads address or bar code information (mail data) from the mailpiece. Next, it is determined whether the mail data matches the selected sort sub-scheme in a step 212. If the mailpiece does match, the mailpiece is sorted, in a step 216, by the sorter 24 to one of the destination pockets 30 designated by the selected sort sub-scheme. From here the process continues to a step 218. If the mailpiece data does not match in the step 212, the mailpiece is rejected in a step 214 and the process continues to the step 218.

At the step 218, an inquiry is made to determine whether more mailpieces remain to be sorted (i.e. mailpieces still in the feeder/reader system) according to the selected sort sub-scheme. If so, the process continues to the step 208 to repeat the feed, read, and sort process. If all mailpieces are sorted, a sweeping operation is performed on the destination pockets 30 associated with the selected sort sub-scheme at a step 220. Additionally after step 218, the process continues to the step 204 to select another sort sub-scheme and sort its associated batch of mail.

As will be understood, while the sweeping operation is being performed on the pockets associated with one sort, a second sort is initiated to sort another batch of mailpieces to pockets associated with the second sort. As such, the sorter 24 is sorting a second batch of mailpieces while the sweeping operation is being performed on the sorted first batch of mailpieces. This continues according to the number of sort sub-schemes to be performed. This increases the time efficiency of the sorter 24, as will be discussed below.

Figure 5:
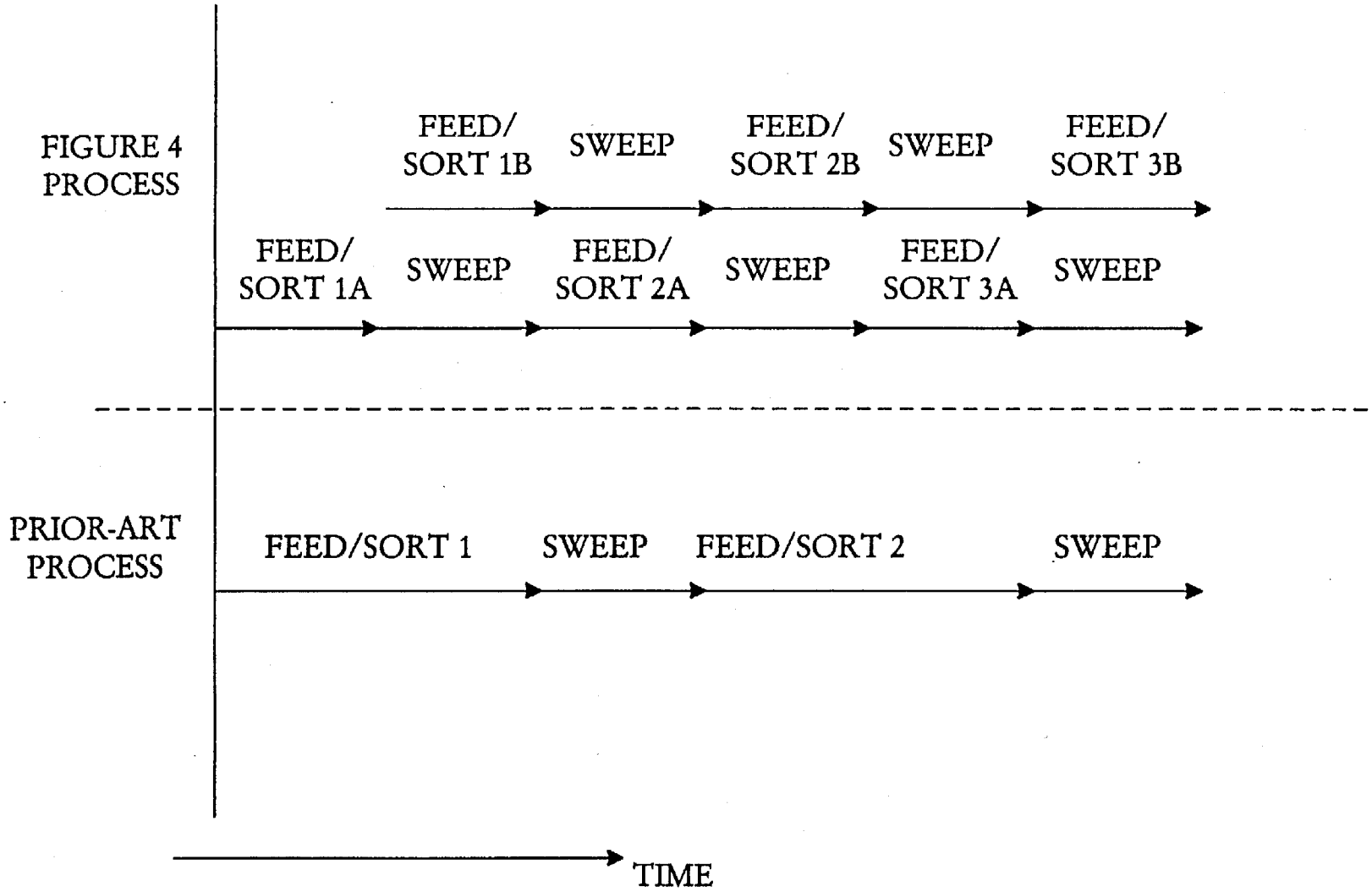
FIG. 5 is a timetable illustrating the amount of time for sorting mailpieces according to the sorting process of the present invention with respect to the amount of time for sorting mailpieces according to the current sorting process.

Now referring to FIG. 5, there is shown a timetable illustrating the amount of time for sorting mailpieces according to the sorting process of the present invention with respect to the amount of time for sorting mailpieces according to a prior art sorting process. As with the current sorting process, after the sorter sorts a batch of mailpieces the feeder is shut down to allow the sweeper to sweep the mailpieces from all destination pockets or bins. After the sweeping process is completed, the feeder is restarted to begin the next sort scheme with a new batch of mailpieces. As such, during the sweep operation, the feeder is idle. The timeline (amount of time required to perform sequential feeds, sorts and sweeps) illustrates the sequential nature of the feeding, sorting and sweeping processes for current sorting processes.

A timeline illustrating the parallel nature of the feeding, sorting and sweeping processes for the new sorting process in accordance with the present invention is also illustrated in FIG. 5. As can be seen, a FEED/SORT 1A is performed by the feeder 20 (in conjunction with the sorter 24) and then the pockets used in the FEED/SORT 1A are swept. While the pockets used in the FEED/SORT 1A are being swept, a FEED/SORT 1B is begun by the feeder 20. After the FEED/SORT 1B is completed, those pockets used in the FEED/SORT 1B are swept. While the pockets used in the FEED/SORT 1B are being swept, a FEED/SORT 2A is begun by the feeder 20, and so on. As such, FIG. 5 illustrates the time saving potential of the sorting process in accordance with the present invention. As will be understood, the timing shown in FIG. 5 is for illustrative purposes only and the timing of each feed/sort and/or each sweep may vary depending on the number of mailpieces in each feed/sort and the number of pockets used by each sort.

In the preferred embodiment, two types of sort sub-schemes, odd and even (for the two sides of the sorting machine), are utilized. A sort sub-scheme designated as an odd sub-scheme will use a first array of destination pockets 26 (preferably one side of the sorter, or one-half of the total pockets 30). A sort sub-scheme designated as an even sub-scheme will use a second array of destination pockets 28 (preferably the other side of the sorter, or one-half of the total pockets 30). If an odd sub-scheme is being run, the associated mailpieces are sorted by direction to the first array of pockets 26. When an even sub-scheme is being run, those associated mailpieces are sorted by direction to the second array of pockets 28. While the mailpieces are being sorted either to the first array 26 or the second array 28 of pockets, sorted mail pieces can be swept from the second array or the first array of pockets, respectively, and without stopping the machine.

Preferably, it is recommended that sub-schemes be run in ascending numerical order. However, it is possible to run sub-schemes out of order, as long as it is run alternatively for odd and even sub-schemes. As will be appreciated, the individual destination pockets or bins can be grouped into any number of groups and include any number of individual pockets to correspond to a particular sub-scheme. As such, there may be any increment of pockets per sub-scheme.

With the sorting process in accordance with the present invention, the number of sorter starts and stops (and time between starts and stops) will be minimized as one side of the sorter is swept while the other side is accepting sorted mail.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention.

What is claimed is:

1. A process for sorting mailpieces in a sorting machine having a first array of pockets and a second array of pockets physically separate from the first array of pockets, comprising the steps of:

sorting during a first time frame and in accordance with a first sorting scheme a first batch of mailpieces into the first array of pockets of the sorting machine;

sweeping during a second time frame subsequent to the first time frame the sorted first batch of mailpieces from the first array of pockets of the sorting machine; and sorting during the second time frame and in accordance with a second sorting scheme a second batch of mailpieces into the second array of pockets of the sorting machine.

2. A process in accordance with claim 1 wherein the first array of pockets comprises a first half of the pockets of the sorting machine and the second array of pockets comprises a second half of the pockets of the sorting machine.

3. A process in accordance with claim 1 further comprising the steps of:

storing address information from a group of mailpieces; and generating a sorting scheme based on the stored address information, said generated sorting scheme comprising the first sorting scheme and the second sorting scheme, and the group of mailpieces comprises the first batch of mailpieces and the second batch of mailpieces.

4. A process in accordance with claim 1 further comprising the steps of:

sweeping during a third time frame subsequent to the second time frame the sorted second batch of mailpieces from the second array of pockets of the sorting machine; and sorting during the third time frame and in accordance with a third sorting scheme a third batch of mailpieces into the first array of pockets of the sorting machine.

5. A process in accordance with claim 1, wherein each pocket of the first and second arrays of pockets has an entry opening through which mailpieces are sorted.

6. A process in accordance with claim 5, wherein the first and second arrays of pockets are disposed in spaced, opposing rows.

7. A process for sorting mailpieces using a sorting machine having a plurality of physically separate destination bins, comprising the steps of:

sorting during a first time frame and in accordance with a first sorting scheme a first group of mailpieces into a first subset of the plurality of destination bins of the sorting machine;

sweeping during a second time frame subsequent to the first time frame the sorted first group of mailpieces from the first subset of the plurality of destination bins of the sorting machine; and sorting during the second time frame and in accordance with a second sorting scheme a second group of mailpieces into a second subset of the plurality of destination bins of the sorting machine, which second subset is different from the first subset of the plurality of destination bins.

8. A process in accordance with claim 7 wherein the first subset of the plurality of destination bins comprises a first half of the destination bins of the sorting machine and the second subset of the plurality of destination bins comprises a second half of the destination bins of the sorting machine.

9. A process in accordance with claim 7 further comprising the steps of:

sweeping during a third time frame subsequent to the second time frame the sorted second group of mailpieces from the second subset of the plurality of destination bins of the sorting machine; and sorting during the third time frame and in accordance with a third scheme a third group of mailpieces into the first subset of the plurality of destination bins of the sorting machine.

10. A process in accordance with claim 7, wherein each bin of the first and second subsets of bins has an entry opening through which mailpieces are sorted.

11. A process in accordance with claim 10, wherein the first and second subsets of bins are disposed in spaced, opposing rows.

12. A process for sorting mailpieces in a sorting machine, comprising the steps of:

reading address information from a group of mailpieces;

storing the address information in the sorting machine;

generating in the sorting machine a sort scheme based on the stored address information; and sorting the group of mailpieces in the sorting machine according to the generated sort scheme wherein said sorting of the group of mailpieces comprises the steps of, sorting in accordance with a first sub-scheme a first batch of mailpieces into a first array of pockets of the sorting machine, sweeping the sorted first batch of mailpieces from the first array of pockets of the sorting machine, and sorting in accordance with a second sub-scheme a second batch of mailpieces into a second array of pockets of the sorting machine physically separate from the first array of pockets during the sweeping of the sorted first batch of mailpieces.

13. A process in accordance with claim 12, wherein each pocket of the first and second arrays of pockets has an entry opening through which mailpieces are sorted.

14. A process in accordance with claim 13, wherein the first and second arrays of pockets are disposed in spaced, opposing rows.

15. A method for sorting mailpieces using a sorting machine having a first array of pockets and a second array of pockets physically separate from the first array of pockets, comprising the steps of:

sorting at least a portion of a first group of mailpieces to the first group of pockets of the sorting machine; and then sorting at least a portion of a second group of mailpieces to the second group of pockets of the sorting machine during a sweep of the first group of pockets of the sorting machine containing sorted mailpieces from the first group of mailpieces.

16. A process for sorting mailpieces in a sorting machine having an array of destination pockets, comprising the steps of:

(a) activating during a first time frame a sorting subscheme resident in a control computer of the sorting machine;

(b) selecting a first array of destination pockets of the sorting machine identified with the activated sorting subscheme;

(c) reading destination information from each mailpiece in a group of mailpieces;

(d) comparing the read destination information to destination information in the activated sorting subscheme;

(e) determining if the mailpiece associated with the destination information matches destination information in the activated sorting subscheme;

(f) sorting a mailpiece associated with destination information matching destination information in the activated sorting subscheme to one of the selected first array of destination pockets identified with the activated sorting subscheme, the sorting of a mailpiece continuing until all mailpieces in a group of mailpieces associated with destination information matching destination information in the activated sorting subscheme have been sorted; and (g) repeating steps (a) through (f) to activate in a second time frame subsequent to the first time frame another sorting subscheme for another group of mailpieces and a second array of destination pockets.

17. A process for sorting mailpieces in accordance with claim 16, including the step of determining whether the destination pockets identified with the activated sort subscheme have been swept after a previous sort to the selected array of destination pockets.

18. A process for sorting mailpieces in accordance with claim 16 including the step of feeding mailpieces from a group of mailpieces into a feeder to be separated and sequentially read for destination information.

19. A process for sorting mailpieces in accordance with claim 18 including the step of determining whether the destination pockets identified with the activated sorting subscheme have been swept after a previous sort to the selected array of destination pockets.

20. A process for sorting mailpieces in accordance with claim 19 including the step of suspending the feeding of mailpieces in accordance with a selected sorting subscheme until the selected array of destination pockets have been swept after a previous sort to the selected array of destination pockets.

21. A process in accordance with claim 16, wherein the pockets of the first and second arrays of pockets are physically separate from one another, and each pocket has an entry opening through which mailpieces are sorted.

22. A process for sorting mailpieces in a sorting machine having an array of destination pockets, comprising the steps of:

(a) selecting a first array of destination pockets of the sorting machine identified with a first sorting subscheme;

(b) feeding mailpieces from a group of mailpieces into a feeder to be separated and sequentially read;

(c) reading destination information from each mailpiece of the group of mailpieces;

(d) comparing the read destination information to destination information in the first sorting subscheme;

(e) determining if the mailpiece associated with destination information matches destination information in the first sorting subscheme;

(f) sorting a mailpiece associated with destination information matching destination information in the first sorting subscheme to one of the select first array of destination pockets identified with the first sorting subscheme, the sorting continuing until all mailpieces associated with destination information matching destination information in the first sorting subscheme have been sorted;

(g) repeating steps (a) through (f) to activate in a second time frame subsequent to the first time frame a second sorting subscheme for another group of mailpieces and a second array of destination pockets.

23. A process for sorting mailpieces in accordance with claim 22 further including the step of determining whether the destination pockets associated with the first sorting subscheme have been swept after a previous sort to the selected array of destination pockets.

24. A process for sorting mailpieces in accordance with claim 23 further including the step of suspending the feeding of mailpieces in accordance with a selected sorting subscheme until the selected array of destination pockets have been swept after a previous sort to the selected pockets.

25. A process in accordance with claim 22, wherein the pockets of the first and second arrays of pockets are physically separate from one another, and each pocket has an entry opening through which mailpieces are sorted.

26. An apparatus for sorting mailpieces comprising:

a sorting machine including a first array of pockets and a second array of pockets physically separate from the first array of pockets; and a control system for controlling the sorting machine in accordance with a first sorting scheme during a first time frame and a second sorting scheme during a second time frame, such that the sorting machine sorts a first batch of mailpieces to the first array of pockets and sweeps mailpieces from the second array of pockets during the first time frame, and sorts a second batch of mailpieces to the second array of pockets and sweeps mailpieces from the first array of pockets during the second time frame.

27. An apparatus for sorting mailpieces in accordance with claim 26 wherein the first array of pockets comprises one half of a plurality of destination pockets of the sorting machine, and the second array of pockets comprises the other half of the plurality of destination pockets of the sorting machine.

28. An apparatus for sorting mailpieces in accordance with claim 26, wherein the control system comprises a control computer for controlling operation of the sorting machine and a host computer for generating the first and second sorting schemes and transmitting the first and second sorting schemes to the control computer.

29. An apparatus for sorting mailpieces in accordance with claim 28 further comprising a feeder for feeding mailpieces into the sorting machine.

30. An apparatus for sorting mailpieces in accordance with claim 29 further comprising a reader for reading address information from the mailpieces before sorting the mailpieces in the sorting machine.

31. An apparatus for sorting mailpieces in accordance with claim 30 wherein the control computer determines if the address information read by the reader corresponds to a group of addresses associated with a selected sorting scheme.

32. An apparatus for sorting mailpieces in accordance with claim 26 wherein the first and second arrays of pockets are disposed in spaced, opposing rows.

* * * * *